United States Patent [19]

Benno

[11] 4,124,139

[45] Nov. 7, 1978

[54] METAL CAN LID WITH A PUSH-IN OPENING DEVICE FOR CANS HAVING PRESSURIZED CONTENTS

[75] Inventor: Edward L. Benno, Grayslake, Ill.

[73] Assignee: Illinois Tool Works Inc., Chicago, Ill.

[21] Appl. No.: 872,397

[22] Filed: Jan. 25, 1978

[51] Int. Cl.[2] ..... B65D 41/32

[52] U.S. Cl. ..... 220/268

[58] Field of Search ..... 220/266–270, 220/90.6

[56] References Cited

U.S. PATENT DOCUMENTS

| | | | |
|---|---|---|---|
| 3,334,775 | 8/1967 | Klein et al. | 220/268 |
| 3,905,513 | 9/1975 | Klein | 220/268 |
| 3,939,787 | 2/1976 | Morrison et al. | 220/270 |
| 3,951,298 | 4/1976 | Klein | 220/268 |
| 4,018,178 | 4/1977 | Klein et al. | 220/268 X |

*Primary Examiner*—George T. Hall

*Attorney, Agent, or Firm*—Robert W. Beart; Edward L. Benno

[57] ABSTRACT

A metal can lid with a push-in opening device for cans having pressurized contents in which the opening device is formed in the lid from the material of the lid and in which the opening device comprises a panel large enough to be pushed into a can to which the lid is applied by a person's finger pushing downwardly on the panel and in which the panel has a folded periphery which remains with the panel as a reinforcement for the panel against bending of the panel as it is pushed downwardly into the can. A portion of the folded periphery is separated by a line of fracture from the lid, and the lid and panel construction are made to avoid sharp exposed edges.

5 Claims, 4 Drawing Figures

METAL CAN LID WITH A PUSH-IN OPENING DEVICE FOR CANS HAVING PRESSURIZED CONTENTS

BACKGROUND OF THE INVENTION

The prior art is replete with push-in opening devices for cans having pressurized contents. Many of the known devices form the push-in panel from the material of the lid. Many known devices provide lines of fracture that reduce the force necessary to open the can. Known devices also teach arrangements avoiding sharp exposed edges which may cut a person's finger in opening the can. Also, devices are known with various forms of embossing in and about the opening devices for reinforcing the thin metal of the devices against undesirable curling or bending as a person opens the can. Some such known devices fail to work as anticipated, while others produce one advantage to the disadvantage of another desired function.

SUMMARY OF THE INVENTION

As opposed to the known lid constructions of the prior art, the subject invention is believed to combine certain elements in a unique arrangement to produce a combination of features not previously known in the art.

The invention involves a metal can lid with a push-in opening device primarily for cans having pressurized contents such as canned beer and soda. The opening device is formed in the lid from the material of the lid and comprises a panel substantially smaller than the total area of the lid but large enough to be pushed into a can to which the lid is applied by a person's finger pushing downwardly on the panel. The panel is formed by an underfoldment of the lid material so that the panel is generally beneath the surface of the lid and larger than the provided opening for pouring of the contents from the can. The panel is associated with the lid across a line of fracture completely through the lid material, across score lines extending from each end of the line of fracture, and through a hinge element. Both the line of fracture and the score lines are in a layer of the lid material in the underfoldment that is on top of the panel and below the lid. With a can having pressurized contents, one result of that construction is that the panel is urged against the underside of the lid toward a sealing condition of the line of fracture. Another result is that sealing compounds are easily associated with the areas of the panel and lid about the line of fracture to adequately seal the line of fracture against leakage once the lid has been applied to a can having pressurized contents and during storage and handling thereafter until eventual intentional opening of the can. A further important result of that construction is that the panel is substantially reinforced by a formed flange or channel on the upper surface of and at the side edges of the panel. That reinforcement stiffens the panel against downward and inward curling or bending as a person pushes the panel into the can in the opening operation of the can and thereby renders the can easier to open by a person pushing down on the panel as the greater stiffness increases the lever arm in the panel for pushing on the panel and tearing the score lines. Those skilled in this art will appreciate the importance of that advantage with the extremely thin sheet material that is presently commercially used to make can ends for beverage containers. In addition to the foregoing advantages, the described construction provides the further feature of a lid opening device construction in which sharp exposed edges are avoided to substantially remove the possibility of a person cutting their finger in opening the can.

The primary object of the invention is to provide a metal can lid for cans having pressurized contents with a simple push-in opening device formed from the material of the lid and in which the opening device is reinforced against curling or bending in use and in which sharp exposed edges are avoided. Other objects and features of the invention will be apparent upon a perusal of the hereinafter following detailed description read in conjunction with the drawing.

DETAILED DESCRIPTION OF THE PREFERRED EMBODIMENTS

Figure 1:
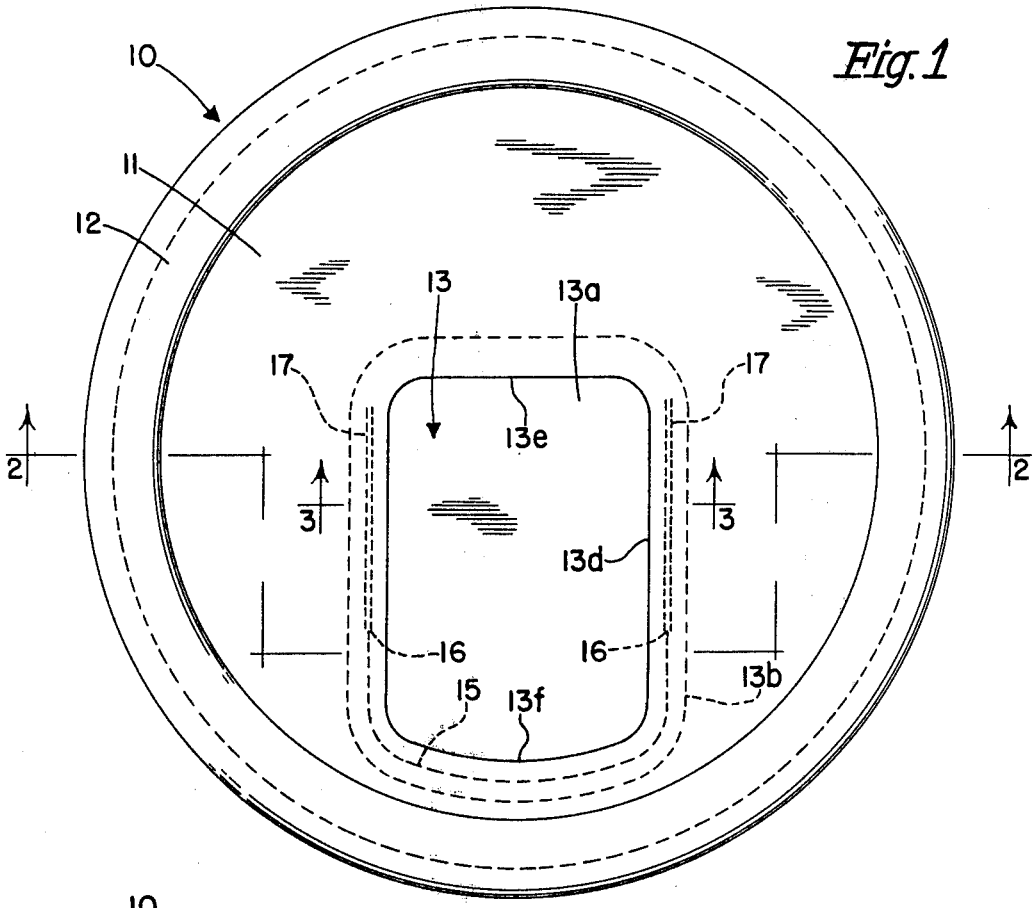
FIG. 1 is a top plan view of one embodiment of a can lid constructed according to the invention.

The can lid 10 shown in the drawing is intended for application to the upper sidewall of a circular can and in which the can is filled with a gaseous beverage such as beer or soda. The lid 10 further comprises a central upwardly convex lid surface 11, a locking flange 12 surrounding the central area 11 and an opening device 13. The lid 10 is formed from a thin material easily bendable metal sheet with appropriate forming equipment to the shape as shown in the drawing and described herein.

Figure 4:
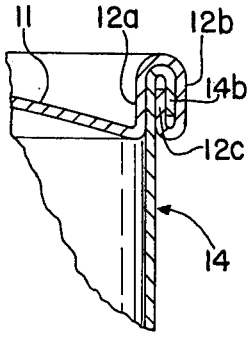
FIG. 4 is a fragmentary cross-sectional view of a portion of a can showing the lid applied thereto.

The circular locking flange 12 is formed with a vertically upstanding wall 12*a*, an annular horizontal wall 12*b* extending radially outwardly from the upper end of the wall 12*a* and an undercurled edge 12*c* on the radially outwardmost edge of the horizontal wall 12*b*. FIG. 4 shows in a fragmentary view a conventional arrangement for locking seaming the lid 10 onto the upper sidewall of a can 14. As shown in FIG. 4, the curled edge 12*c* is bent upwardly and between the sidewall of the can 14 and a downwardly formed flange 14*b* of the can 14. The horizontal wall 12*b* is bent downwardly tightly against the flange 14*b* to securely lock the lid 10 on the can 14.

The opening device 13 preferably comprises an elongated panel 13*a* of an area substantially smaller than the central lid area 11. The invention contemplates that the panel 13*a* may have configurations other than the rectangular rounded corner configuration shown. For example, the panel 13*a* may be pear shaped or even circular. The panel must have a length and width sufficient to enable a person to push downwardly on the panel 13*a* with one finger of their hand. The opening device 13 is further preferably aligned in the central lid area 11 so that the longitudinal axis of the panel 13*a* lies substantially on a radius of the lid 10 with one end of the panel 13*a* closely adjacent to the locking flange 12.

Figure 2:
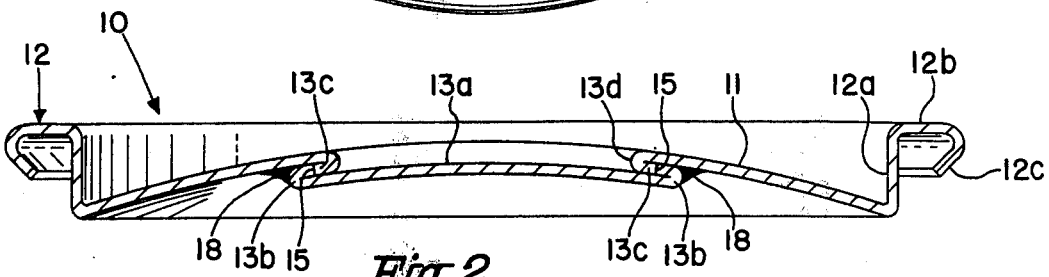
FIG. 2 is a cross-sectional view of the lid of FIG. 1 and taken substantially along the line 2—2 of FIG. 1.

The opening device 13 is formed as an underfoldment of the lid material. That underfoldment is such that the panel 13*a* is beneath the central lid area 11 and the periphery of the panel 13*a* is bent in a substantially 180° bend 13b over and onto the upper surface of the panel of 13a as may be seen in FIG. 2. The underfoldment further comprises a relatively narrow strip 13c. One longitudinally extending edge of the strip 13c is integrally formed with the upper inward edge of the fold 13b. The other longitudinally extending edge of the strip 13c is integrally connected to one edge of a second 180° fold 13d. The other edge of the fold 13d is integrally connected with and merges into the central lid area 11. As shown in FIG. 2, the upper surface of the strip 13c is in surface contact with the underside of the central lid area 11, and the underside of the strip 13c is in surface contact with the upper surface of the panel 13a. The invention contemplates that the underfoldment need not be circumferentially complete about the opening device 13 but alternatively can terminate adjacent the radially inward end of the opening device 13 such as at the area 13e indicated in FIG. 1. In whatever configuration selected, the end 13e of the opening device 13 should have sufficient integrity to be a hinge that securely holds the panel 13a to the central lid area 11 after the panel 13a has been pushed into the can to open the can.

The opening device 13 further comprises a line of fracture 15 extending completely through the thickness of the strip 13c. The line of fracture 15 extends longitudinally of the strip 13c between the longitudinal side edges thereof. The line of fracture 15 further extends longitudinally of the strip 13c completely across the end 13f of the opening device 13. As may be seen in FIG. 1, the end 13f is on the opposite side of the opening device 13 from the hinge area 13e. Preferably the line of fracture 15 further extends from the end 13f a substantial distance longitudinally of the longitudinal side portions of the opening device 13. As shown in FIG. 1, the line of fracture 15 terminates at 16 which is roughly about one-third of the length of the opening device 13.

Figure 3:
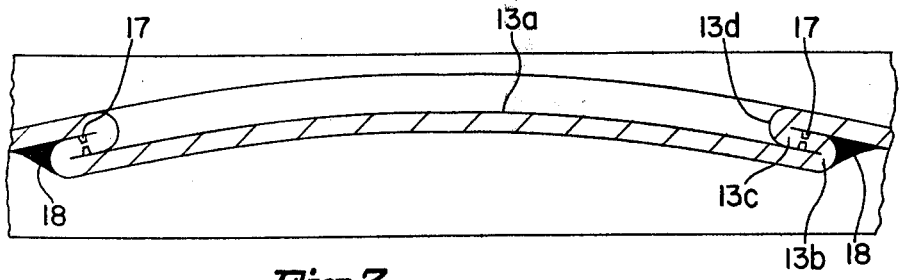
FIG. 3 is an enlarged cross-sectional view of the lid of FIG. 1 and taken substantially along the line 3—3 of FIG. 1.

The opening device 13 further comprises a pair of score lines 17. As shown in a preferred embodiment in FIG. 3, score lines 17 comprise a partial scoring of the strip 13c in both the upper and lower surfaces thereof. One end of each of the score lines 17 extends from one end of the line of fracture 15 as may be seen in FIG. 1. The score lines 17 are further disposed between the longitudinal side edges of the strip 13c and the other end of each score line 17 terminates short of the hinge area 13e.

In the embodiment shown, the line of fracture 15 is sealed by a known sealing compound shown at 18. The compound 18 should be inert and safe for the intended use of the contents of the can and should further be substantially easily fractureable in shear. The compound 18 should further be selected from those known compounds that will effectively block the passage of a liquid or gas therethrough under the contemplated fluid pressures in the filled can to which the lid has been applied for at least the normal period of time that the filled can is expected to remain unopened. As shown, the compound 18 is formed as a fillet between the underside of the central lid area 11 and fold 13b of the opening device 13. The compound 18 may also be applied between the underside of the central lid area 11 and the upper side of the strip 13c of the opening device 13, and should extend about the periphery of the opening device 13 at least for the extent of the line of fracture 15 and about the ends of the line of fracture 15 between the upper surface of the strip 13c and the underside of the central lid area 11.

Upon application of the lid 10 to a can 14 having pressurized contents, it may be seen that the line of fracture 15 is inherently shielded, stabilized and sealed by the metal of the lid thereabout. Further, gas pressure within the can tends to further urge the opening device 13 toward keeping the line of fracture 15 closed.

In using the opening device 13 to open a can 14 to which the lid 10 has been applied, a person using one of their fingers pushes downwardly on the panel 13a adjacent the end 13f to break the sealing means 18, to open the line of fracture 15 and to begin to effectively pivot the panel 13a about the hinge end 13e downwardly and into the can 14. Importantly, the fold 13b and the portion of the strip 13c integral therewith will reinforce the panel 13a against excessive bending or curling as the opening operation continues. When the line of fracture 15 is open to the beginning of the score lines 17 at 16, the further opening operation will initiate tearing of the strip 13c along the score lines 17. With the panel 13a functioning substantially as a lever, continued pushing thereon as described above will permit a person to produce a relatively unobstructed opening in the can 14.

It should be noted that in the can opening operation described above, there are no exposed sharp metal edges that could cut a person's finger during the opening operation.

Having described the invention, it should be understood that changes can be made in the described embodiments by one skilled in the art within the spirit and scope of the claims.

I claim:

1. A metal can lid with a push-in opening device for cans having a pressurized contents, said opening device comprising a panel formed in said lid from the material of said lid, the material of said lid being a metal sheet sufficiently thin and flexible to be easily bent by a person in a single thickness portion thereof, said panel having an area substantially smaller than the area of said lid but large enough to be pushed by a person's finger downwardly into a can to which said lid is applied, at least a substantial circumferential portion of said panel formed as an underfolded section of said material, said underfolded section comprising a first fold of said material at the periphery of said panel with said first fold being a substantially 180° fold over and onto the upper surface of said panel, said underfolded section further comprising a strip of said material on the upper surface of said panel, said strip extending longitudinally substantially the length of said underfolded section with one longitudinal edge thereof integral with the end of said first fold on the upper surface of said panel and with the other longitudinal edge thereof integral with one end of a second fold of said material, said second fold of said material being a substantially 180° fold over and onto the upper surface of said strip with the other end thereof merging integrally into the material of said lid circumferentially about said panel, a substantial longitudinal segment of said strip having a line of fracture completely through said material, whereby said first fold and the portion of said strip integral therewith provide an edge reinforcement of said panel against bending of said panel by a person's finger pushing downwardly on said panel adjacent said line of fracture.

2. A metal can lid as defined in claim 1, and frangible in shear sealing means on the underside of said lid and panel for providing a substantial barrier across said line of fracture to the passage of a liquid and gas from the underside of said lid through said line of fracture.

3. A metal can lid as defined in claim 1, and a second substantial segment of said strip at each end of said line of fracture having score lines extending partially through the thickness of said material.

4. A metal can lid as defined in claim 3, and a substantial portion of the periphery of said panel between the ends of said score lines being unscored to an extent providing a hinge for securely holding said panel to said lid when said panel is pushed downwardly away from said lid to open said line to fracture and to tear said score lines.

5. A metal can lid as defined in claim 4, said lid being a circular lid for a round can and having a curled edge about the periphery thereof for seaming cooperation of said curled edge with the upper edge of the sidewall of said can, said panel being elongated and the longitudinal axis of said panel lying generally on a radius of said lid with one end of said panel adjacent to said curled edge, and said substantial longitudinal segment of said strip having said line of fracture spanning said one end and portions of the longitudinal sides of said panel adjacent said one end thereof.

* * * * *